United States Patent [19]

Wheelock

[11] Patent Number: 4,912,786

[45] Date of Patent: Apr. 3, 1990

[54] FEET IMMERSION TRAY

[76] Inventor: Francis N. Wheelock, 851 Elm St., Somerset, Mass. 02726

[21] Appl. No.: 272,066

[22] Filed: Nov. 16, 1988

[51] Int. Cl.[4] ..... A47K 3/022; A61H 35/00; E03C 1/00

[52] U.S. Cl. ..... 4/622; 4/574; 4/661; 128/370; 220/20

[58] Field of Search ..... 4/574, 577, 622, 621, 4/661; 128/370; 220/20; 229/2.5 R

[56] References Cited

U.S. PATENT DOCUMENTS

| | | | |
|---|---|---|---|
| D. 250,206 | 11/1978 | Levin | 4/622 |
| 1,060,236 | 4/1913 | Dodge | 4/622 |
| 1,970,465 | 8/1934 | Martindell et al. | 4/622 |
| 3,283,756 | 11/1966 | Turley | 128/370 X |
| 3,341,876 | 9/1967 | Campbell | 220/20 X |
| 3,851,340 | 12/1974 | Keusch | 4/622 |
| 3,965,495 | 6/1976 | McNair | 4/622 |
| 4,520,525 | 6/1985 | Yogi et al. | 4/574 |

*Primary Examiner*—Henry K. Artis

[57] ABSTRACT

A germical liquid-containment tray positionable alongside a swimming pool so that a person can stand in the tray to remove germs and/or dirt from the sole areas of his/her feet prior to entering the pool. The tray has the shape of two human feet, such that persons are alerted to the purpose of the tray without having to read special instructions or make inquiries of the pool owner.

1 Claim, 1 Drawing Sheet

FEET IMMERSION TRAY

BACKGROUND AND SUMMARY OF THE INVENTION

This invention relates to a germicidal liquid-containment tray positionable at a swimming pool so that swimmers can stand in the tray to immerse their feet in the germicidal solution prior to entering the pool. The aim is to remove germs, grass clippings, dirt, etc. from the person's feet, to thereby help keep the pool safe and enjoyable for pool users.

Prior to my invention others have suggested various types of trays or foot cleansing devices usable at poolside or elsewhere. U.S. Pat. No. 1,060,236 to W. Dodge shows a tray having a series of ribs 4 to engage the sole areas of a person's feet.

U.S. Pat. No. 1,970,465 to Martindell et al shows a square tray formed of hard vulcanized rubber; a strengthening flange 3 extends outwardly and downwardly from the tray side wall 2.

U.S. Pat. 3, 851,340 to A. Keusch shows an oval shaped tray having separate chambers 5 and 7 for the person's feet; a liquid mixing cavity 9 communicates with the separate chambers.

My invention relates to a tray that includes two separate tray sections having the outline shape of two human feet. The "human foot" shape of the two tray sections is designed to inform each pool user as to the purpose of the tray, i.e. that the person is expected to stand-in the tray for a moment before entering the pool. No instructions need to be printed on the tray; the person is informed of the purpose for the tray without any instructions.

The two tray sections are preferably connected together by two transverse liquid channel structures such that germicidal liquid can circulate between the two tray sections. When adding liquid to the tray the liquid needs to be poured only into one of the tray sections. The other tray section is filled through the connecting channel structures.

By forming the tray to include two tray sections shaped to the outline of a person's feet, it is possible to economize on the quantity of germicidal liquid required to achieve immersion of the user's feet. The liquid is enabled to surround a person's feet with minimum clearance between the feet and the tray section side walls; there are substantially no unused corners or pockets.

The tray structure is designed so that the aforementioned transverse channel structures form reinforcements for the tray section side walls, thereby making it possible to economize on construction materials by reducing the thickness dimensions of the tray walls.

THE DRAWINGS

DESCRIPTION OF A PREFERRED EMBODIMENT OF THE INVENTION

Figure 1:
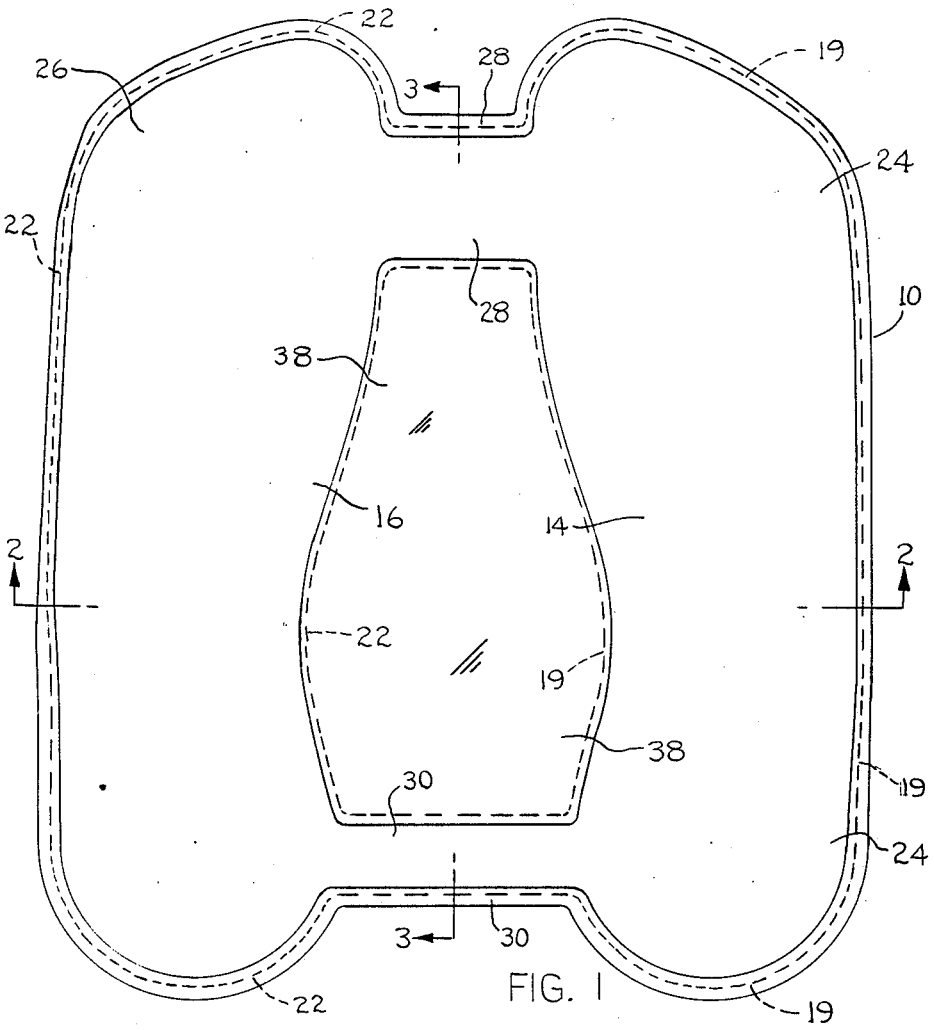
FIG. 1 is a top plan view of a tray constructed according to my invention.

The drawings show a germicidal liquid-containment tray 10 adapted to be positioned at a swimming pool so that users of the pool can stand in the tray to immerse their feet in the germicidal solution prior to entering the pool. The liquid agent is not shown in the drawings, but would be added to the tray to some suitable level, e.g. the level designated by numeral 12 in FIG. 2. The liquid level is not critical.

Tray 10 comprises two separate tray sections 14 and 16. Tray section 14 comprises a bottom wall 17 and an upstanding side wall 19. Wall 19 extends around the peripheral edge of wall 17. As seen in FIG. 1, wall 19 has an outline shape that corresponds to the shape of a human right foot. the space encompassed within wall 19 is however slightly larger than the average human foot so that a person having large feet can stand in the tray. A human foot may be on the order of ten inches long. Wall 19 may be sized so that the length dimension of the circumscribed space is about eleven or twelve inches, leaving some clearance between the foot and tray side wall 19.

Tray section 16 is similar to tray section 14 except that it has a top plan configuration corresponding to the outline shape of a human left foot. Tray section 16 comprises a bottom wall 20 and a peripheral upstanding side wall 22.

Figure 3:
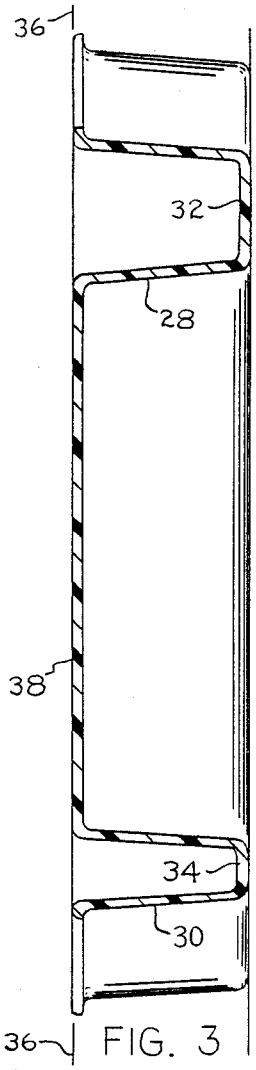
FIG. 3 is a sectional view on line 3—3 in FIG. 1.

Tray section 14 defines a foot-reception cavity 24. Tray section 16 defines a foot-reception cavity 26. These two cavities are connected together (in a fluid sense) by two channel structures 28 and 30 located, respectively, at the toe ends of the cavities and at the heel ends of the cavities. FIG. 3 shows the channel cross-sectional nature of each connecting structure 28 or 30.

Each channel structure 28 and 30 comprises a bottom wall 32 and 34 that is in the same horizontal plane as the bottom walls 17 and 20 tray sections 14 and 16. Therefore, liquid that is poured into either tray section will automatically flow through channel structures 28 and 30 to define a common liquid level in both tray sections. This type of liquid communication offers some assurance that if there is any liquid in the tray both of the person's feet will be immersed.

Figure 2:
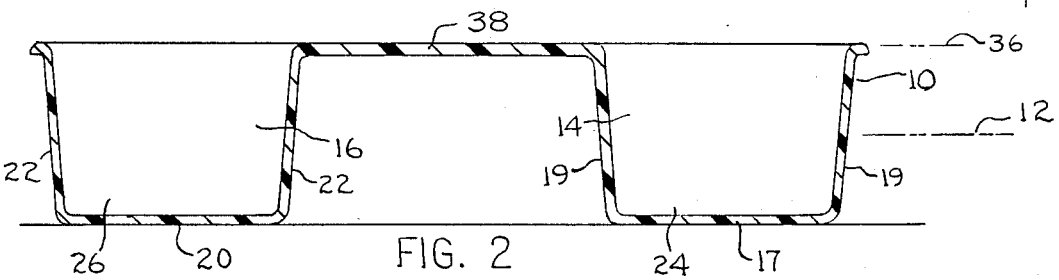
FIG. 2 is a sectional view on line 2—2 in FIG. 1.

The tray section side walls 19 and 22 have their upper edges located in a common horizontal plane, identified by numeral 36 in FIGS. 2 and 3. A horizontal tray top wall 38 extends between tray sections 14 and 16 in the horizontal plane 36. The aforementioned channel structures 28 and 30 are located at opposite extremities of top wall 38, as seen in FIG. 3.

The illustrated tray structure is believed to have some advantages over known prior art structures. Of primary importance is the fact that the shapes of the two tray sections 14 and 16 provide a visual instruction to pool users that they are to immerse their feet in the tray before entering the swimming pool. This feature increases the usage of the tray and thus its value to the pool owner.

Another feature of some importance is the relatively small clearance between each person's foot and the adjacent tray section side wall 10 or 22. Each tray section conforms to the person's foot outline such only a small quantity of liquid germicidal agent is required for immersion of the person's feet.

It is also believed that the tray configuration contributes to a mutual structural strengthening of the various tray walls. Top wall 38 cooperates with the connected side walls 22 and 19 to provide a relatively strong channel configuration, as seen in FIG. 2; this strengthening configuration extend along a substantial portion of the tray section length, i.e. from channel 28 to channel 30. Each channel 28 or 30 adds additional strength to the tray structure. The tray may be formed as a one piece plastic molding.

The drawings show one particular form that the invention can take. Other forms are possible.

I claim:

1. A germicidal liquid-containment tray positionable at a swimming pool so that swimmers can stand in the tray to immerse their feet in the germicidal agent prior to entering the pool;

said tray comprising two separate spaced-apart tray sections; one of said tray sections comprising a bottom wall and an upstanding side wall extending therearound, said side wall having the outline shape of a human right foot in top plan configuration;

the other tray section comprising a second bottom wall and a second upstanding side wall extending therearound, said second side wall having the outline shape of a human left foot in top plan configuration;

said upstanding side walls comprising curved toe sections, curved heel sections, generally straight outer side wall sections, and inner side wall sections having concave facing surfaces defining instep areas of the respective human foot outlines;

the first and second upstanding side walls having free upper edges terminating in a common horizontal plane spaced above the associated bottom walls a substantial distance sufficient for liquid immersion of a human foot; the vertical distance between said bottom walls and upper edges of the side walls constituting the entire vertical thickness of the liquid-containing tray;

a first channel wall structure extending between the separate tray sections a slight distance rearwardly from the curved toe sections;

a second channel wall structure extending between the separate tray sections a slight distance forwardly from the curved heel sections;

and a tray top wall extending between the separate tray sections in the horizontal plane defined by the upper edges of the tray the first and second channel wall structures being located at opposite extremeties of the tray top wall; each channel wall structure including a flat bottom wall located in the same plane as the bottom walls of the separate tray sections;

said channel wall structures and tray top wall being molded components integral with the separate tray sections, whereby the top wall and channel wall structures act as reinforcement devices for the tray sections.

* * * * *